United States Patent [19]

Steele et al.

[11] Patent Number: 4,470,598

[45] Date of Patent: Sep. 11, 1984

[54] WHEELCHAIR BOWLING APPARATUS

[76] Inventors: Kenneth L. Steele, 1351 Wardman Dr., Brea, Calif. 92621; Thomas J. McLane, 1015 N. Norma, Ridgecrest, Calif. 93555

[21] Appl. No.: 425,290

[22] Filed: Sep. 28, 1982

[51] Int. Cl.[3] ..... A63D 5/00

[52] U.S. Cl. ..... 273/54 R; 280/289 WC

[58] Field of Search ..... 273/54 R, 54 B, 54 D, 273/37, 38, 129 R, 129 L, 129 M, 129 S; 280/289 WC; 297/217; 434/249

[56] References Cited

U.S. PATENT DOCUMENTS

| | | | |
|---|---|---|---|
| 3,037,299 | 6/1962 | Telford | 273/37 X |
| 3,083,967 | 4/1963 | Steel | 273/54 R |
| 3,236,223 | 2/1966 | Rockwood | 273/54 R X |
| 4,368,898 | 1/1983 | Lay | 273/54 R X |

*Primary Examiner*—William H. Grieb
*Attorney, Agent, or Firm*—James F. Kirk

[57] ABSTRACT

A bowling apparatus is provided for use by an operator in a wheelchair to triggerably launch a ball, the ball rolling in a preselected direction on a navigable surface such as a bowling alley. The bowling apparatus is further adapted to control the terminal velocity and spin of the ball at release. The bowling apparatus comprises:

a frame disposed in relative horizontal relation with the navigable surface;

a coupling system for coupling the frame to the wheelchair;

a ball receiver for holding the ball in registration;

a spin control unit for controlling the spin imparted to the ball prior to release, the spin control unit, being coupled to the ball receiver and being interposed between the ball receiving means and the ball and being further adapted to couple the predetermined directional thrust from the ball receiver to the ball;

a propulsion unit for imparting a preselected thrust to the ball receiver, the propulsion unit being further adapted to couple the ball receiver to the frame in wheelchair driven, frame coupled, target pointing relation for imparting a predetermined directional thrust to the ball receiver;

a release unit for actuating the propulsion unit, the release unit being responsive to operator triggering thereby, allowing the propulsion unit to impart the predetermined directional thrust to the ball receiver.

19 Claims, 9 Drawing Figures

WHEELCHAIR BOWLING APPARATUS

BACKGROUND OF THE INVENTION

1. Field of the Invention

This invention relates to the field of recreational apparatus and particularly to the field of recreational apparatus for wheelchair confined operators. The apparatus is principally intended for temporary recreational attachment to an electric wheelchair; however, use of the apparatus is foreseeable on non-electrical manually operated wheelchairs as well.

2. Description of the Prior Art

Presently known bowling apparatus intended for use by wheelchair confined operators are typically placed alongside of the wheelchair as a standing frame and have a declining ramp leading towards the target area. The operator manually positions the frame to achieve directional control of a bowling ball at launch. A ball is placed on the launching ramp and released by the operator.

The apparatus thus described provides for no ball control once the ball is released and begins to roll down the declining plane. The spin of the ball may not be enhanced by the operator, nor may the amount of power and speed that can be imparted to the bowling ball at launch be changed. Each of the aforementioned parameters is limited by the height of the ramp employed by the apparatus. In these prior art configurations, the operator is at rest as the ball is launched and therefore fails to realize a sense of control over the speed of the ball at launch. Absence of this control tends to reduce the level of enjoyment experienced by the participating operator.

In addition to the aforementioned disadvantages, the prior art apparatus lacks mobility in that the operator must transport the prior art apparatus with him as cargo on the chair as he approaches the alley or his respective turn. All known prior art units are manually held or free standing.

SUMMARY OF THE INVENTION

It is, therefore, a major objective of this invention to provide a bowling apparatus for attachment to a wheelchair, and for use by a wheelchair confined operator interested in pursuing the sport of bowling with the aid of this invention apparatus adapted to provide a player with a range of choices and elections. The invention apparatus is particularly suited for use with electrically driven wheelchairs customarily used by paraplegic, or quadraplegic operators. Operators having severe limitations will require the aid of an assistant.

Another objective of the invention apparatus is to enable the operator to modify the launch velocity of the ball by controlling the speed of the wheelchair towards the entrance to the bowling alley at the instant of launch.

Another objective of the invention is to provide an operator with a means of modifying the spin imparted to the ball at the point of launch.

An important objective of the present invention bowling apparatus is that the operator derives mobility, in that the operator, drives the chair with the apparatus attached, to or from the alley entrance without the burden of having to carry an apparatus with him. The invention bowling apparatus is integrally attached to the wheelchair and conveniently transported by the wheelchair as it is driven to or from the alley.

Another objective of the invention is to provide convenient and quick means of coupling the apparatus to the wheelchair.

These and other objectives of the invention are realized in a bowling apparatus for use by an operator in a wheelchair to triggerably launch a ball to roll in a preselected direction on a navigable surface toward a target. The bowling apparatus is further adapted to control terminal velocity and spin of the ball at release and comprises: a frame disposed in relative horizontal relation with the navigable surface; a coupling means for coupling the frame to the wheelchair; a ball receiving means for holding the ball in registration.

The apparatus also comprises propulsion means having a reset configuration and a released configuration, the propulsion means is adapted to store energy upon being reset into the reset configuration. The propulsion means is further adapted to release energy upon being released to the released configuration. The propulsion means is further adapted to couple the ball receiving means to the frame in wheelchair driven, frame coupled, target point relation for imparting a predetermined directional thrust to the ball receiving means.

The bowling apparatus also comprises a release means for unlatching the propulsion means into a released configuration. The release means is responsive to operator triggering to release the propulsion means to the released configuration; thereby, allowing the propulsion means to impart the predetermined directional thrust to the ball receiving means.

Subsequent to latching the propulsion means into a reset configuration, the operator positions the wheelchair to align the propulsion means with the operator selected target. The operator then places a ball in the ball receiving means, and after placing the chair in motion toward the target, or from a sttionary wheelchair position, the operator, at operator election triggers the release means to remotely release the propulsion means; thereby, thrusting the ball, toward the target, in the preselected direction.

In a more particular embodiment, the frame further comprises: a left member having a first and second end; a right member having a first and second end; a left spreader having a first and second end; a right spreader having a first and second end; a center member having a first end having a left and right pivot point; and a second end having a left and right pivot point, the center member having a longitudinal axis disposed in relatively horizontal relation with the navigable surface and centrally positioned between the left and right frame members. This embodiment also provides means for coupling the left spreader first end to the left member mid-region; means for coupling the right spreader first end to the right member mid-region; means for coupling the left member first end to the center member first end left pivot point, means for coupling the left spreader second end to the center member second end left pivot point; means for pivotally coupling the right member first end to the center member first end right pivot point, and means for coupling the right spreader second end to the center member second end right pivot point.

Each of the above mentioned coupling means is further adapted and adjusted to position and hold the left member, right member, center member, left spreader and right spreader in fixed relation. The respective means for coupling the left and right spreader first ends to the left and right member mid-regions are adjusted to conform the distance between the left and right member second ends to the width of the wheelchair in frame to wheelchair coupling relation and to align the frame center member longitudinal axis with the direction of forward travel of the wheelchair. The frame center member longitudinal axis forms a target pointing axis.

In a more particular embodiment of the above embodiment, the wheelchair is required to have a seating platform having an upper and lower surface, a left and right caster, each of the caster having a rotatable wheel in contact with the navigable surface. With the seating platform being disposed in relatively horizontal seating relation with the navigable surface above the casters, the seating platform is supported by: a left forward vertical support, the left forward vertical support being vertically interposed between the left caster and the seating platform lower surface, a right forward vertical support, the right forward vertical support being vertically interposed between the right caster and the seating platform lower surface, a lower left longitudinal brace having a forward end rigidly coupled to the left forward vertical support in close relation with the left caster, a lower right longitudinal brace having a forward end rigidly coupled to the right forward vertical support in close relation with the right caster.

For operation with the above described wheelchair, the invention coupling means for coupling the frame to the wheelchair comprises: a left and right integral body piece, means for coupling as a swivel the left and right integral body pieces respectively to respective frame left and right member second ends. The left and right integral body piece are adapted to be swiveled from an uncoupled position to a coupled position to respectively engage and couple to respective left and right forward vertical supports. Upon swiveling and engaging the left and right body integral pieces with the respective left and right vertical supports, the coupling means for coupling the frame to the wheelchair couples the frame to the wheelchair in relative horizontal relation with the navigable surface.

In another more particular embodiment of the previous embodiment, the means for coupling as a swivel the left and right integral body pieces to respective left and right member second ends further comprises: left and right blade elements, each respective blade element having a blade end and a pivot end. Each respective left and right frame member second end is equipped with a yoke and each respective yoke is adapted to receive a respective blade element blade end in relatively horizontal plane relation. A means for pinning on a swivel axis each respective blade end in its respective yoke is required. Each respective blade element and yoke are adapted to permit free pivotal movement of the blade ends in the yokes on the swivel axis. The swivel axis is relatively normal, or at right angle with, the navigable surface, each respective blade element pivot end being pivotally coupled on a pivot axis to a respective integral body piece.

In an even more particular embodiment of the previous embodiment, each respective integral body piece is further adapted to have a respective pivotal surface, each respective pivotal axis being normal to the pivotal surface. Each respective integral body piece is also adapted when coupled to a respective vertical support to position its respective pivotal axis to be relatively horizontal and transverse to the center member longitudinal axis. In this embodiment, the means for coupling each the respective blade element pivot end to a respective integral body piece pivotal surface provides pivotal freedom for the frame to permit the frame to travel across surfaces slightly non-planar or inclined to the navigable surface.

In yet an even more particular embodiment of the previous embodiment, the left and right integral body pieces are further adapted to engage and rigidly couple to the respective lower left and lower right longitudinal braces. In this adaptation, the left and right integral body pieces, when swiveled into a coupled position, concurrently engage respective left and right forward vertical supports and respective lower left and lower right longitudinal braces to rigidly couple the respective left and right frame members to the chair in intersecting plane relation with the navigable surface.

In an alternative and yet more particular embodiment of the invention bowling apparatus, the ball receiving means further comprises: a U-shaped frame having integrally shaped left and right parallel sides and a base member. The parallel sides are spaced to restrain and register, or hold, the ball prior to launching. The spacing is adapted to provide a ball release aperture from which the ball emerges as it is released. The ball receiving means also includes a U-shaped frame having an upper and lower surface. The lower surface is disposed in relatively horizontal relation with the navigable surface. In this alternative embodiment, the U-shaped frame member is coupled to the propulsion means for imparting a predetermined directional thrust to the ball receiving means. In operation, the ball receiving means is adapted to retain the ball in registration as the ball is accelerated toward the target. The ball exits the ball release aperture at termination of the acceleration. The ball thereafter follows the operator controlled, wheelchair driven and aligned, preselected course toward the target.

In an even more particular embodiment of the above described ball receiving means, a means for supporting the center member in relative horozontal relation with, and at a predetermined height above, the navigable surface is provided. The means for supporting the center member operates to prevent the center member from being deflected toward the navigable surface.

In a most particular embodiment of the above described means for supporting the center member, a caster is coupled to the center member and is adapted to prevent the center member from being deflected into the navigable surface.

A most particular embodiment of the ball receiving means includes: means for supporting the U-shaped frame in horizontal relation with and at a predetermined height above the navigable surface. The means for supporting the U-shaped frame is adapted to prevent the U-shaped frame from being deflected into the navigable surface.

Another most particular embodiment of the ball receiving means includes means for supporting the U-shaped frame further comprising left and right casters, each respective caster having a roller. The left and right casters are respectively coupled to the U-shaped frame left and right side lower surface, the respective rollers being in contact with the navigable surface. In this embodiment, the left and right U-shaped frame casters operate to fix the distance between the U-shaped frame and the navigable surface.

In a more particular embodiment of the invention bowling apparatus, the spin control means is adapted to be responsive to operator control to pre-select the amount of torque applied to the ball as the ball receiving means is accelerated by the propulsion means prior to launch of the ball. This embodiment allows the operator to control the ball spin as the ball travels to the target.

In a more particular embodiment of the spin control means, the spin control means furthur comprises: first and second thrust rollers. Each respective thrust roller is rotatably mounted in respective left and right thrust roller yokes. The left and right thrust roller yokes are positioned on the U-shaped frame upper surface at opposing ends of the U-shaped frame base member. The yokes are further adapted to position the left and right rollers to contact the ball at alternate points of contact above the navigable surface at a height exceeding a distance equivalent to the radius of the ball. In this manner, the respective thrust rollers are adapted to apply a thrust force to the ball at points of roller contact and to operate in cooperation with the frame to accelerate the ball in response to release of the propulsion means. By contacting the ball at a point above the ball's radius, the thrust rollers operate to prevent the ball from being lofted or raised from the navigable surface as it is accelerated.

In another more particular embodiment of the above described spin control means, the spin control means is further comprised of first and second thrust roller brake means for applying, at operator election, a predetermined breaking torque to the first and second thrust rollers. The the first and second thrust roller are selected to apply a frictional load in cooperation with thrust applied at each respective point of roller contact with the ball. In this manner, the thrust force applied at the respective points of contact in cooperation with the ball contact with the navigable surface cooperate with the selected braking applied to the thrust rollers to induce a predetermined spin as the ball is accelerated.

Another more particular embodiment of the previously described propulsion means further comprises: a drive piston having a first and second end, the drive piston first end being rigidly coupled to the ball receiving means base member; a guide means coupled to the frame center member for receiving and guiding the drive piston in parallel relation with the frame center member longitudinal axis through a predetermined thrust translation, the drive piston being positioned and held by the guide means in parallel relation with the frame center member longitudinal axis; a resettable energy storage means for storing energy, the resettable energy storage means being responsive to triggering of the release means by the operator to provide a thrust force at the drive piston second end with respect to the frame center member, the direction of the force being relatively parallel to the center member longitudinal axis and directed from the center member second end toward the center member first end. In this embodiment, the drive piston, being responsive to the force and positioned and held by the guide means, translates the ball receiving means through the predetermined thrust translation to launch the ball to the target.

In another even more particular embodiment of the resettable energy storage means, the resetable energy storage means comprises: at least one spring having a first and second end, the first end being coupled to the drive piston second end, and the second end being coupled to the center member. With this configuration, each spring is extended beyond its relaxed length as the propulsion means is latched in a reset configuration. The spring operates to store energy in its extended configuration and to release the energy in response to the release means unlatching the propulsion means in response to operator triggering.

In another more particular embodiment of the means for coupling as a swivel the left and right integral body pieces to respective frame members furthur requires that the left and right integral body pieces be further adapted to be coupled together by at least one frame spring means. The frame spring means is adapted to hold the left and right integral body pieces in rigid contact with the left and right vertical supports respectively.

In another more particular embodiment of the above described frame spring means, the frame spring means further comprises at least one elastomeric bungee for coupling the left integral body piece to the right integral body piece. In this manner, the bungee operates to conveniently and quickly couple and decouple the respective integral body pieces from the left and right vertical supports.

In a more particular embodiment of the release means for latching the propulsion means into a reset configuration, the release means further comprises: a solenoid having a housing and a spring restored and electrically actuated plunger, the solenoid housing is rigidly coupled to the center member; a bell crank, the bell crank having a pivot point, a solenoid plunger coupling point and a latch; the drive piston first end having a cavity adapted to receive the bell crank latch, the bell crank plunger coupling point being coupled to the solenoid plunger, the bell crank pivot point being pivotally coupled to the center member, the bell crank being free to pivot on the pivot point. Upon being electrically actuated, the solenoid plunger is moved in relation to the solenoid housing. The solenoid plunger is coupled to the bell crank coupling point and applies a torque to the bell crank about the bell crank pivot point. The bell crank rotates in response to the torque, the latch being drawn from the drive piston cavity thereby releasing the drive piston. The drive piston is driven by the extended spring to transmit force to the ball receiving means base member in response to operator triggering to the electrical solenoid.

Another alternative embodiment of the invention bowling apparatus includes a spin control means further comprised of first and second thrust roller motor means for applying, at operator election, independent torques to the first and second thrust rollers. The applied torque is adapted to either break or accelerate the ball spin as the ball is accelerated subsequent to operator release. In this embodiment, the first and second thrust rollers operate to provide predetermined torques to the ball during acceleration to achieve a predetermined spin on the ball.

Another alternative embodiment of the invention bowling apparatus comprises: a frame coupled to a wheelchair, a propulsion means for imparting a preselected thrust to the ball receiving means, the propulsion means being coupled to the frame; a ball receiving means coupled to the propulsion means for holding the ball during acceleration of the ball until release; spin control means for controlling the spin of the ball at release, the spin control means being coupled to the ball receiving means and being interposed between the ball receiving means and the ball; release means responsive to operator triggering to actuate the propulsion means, the release means being coupled to the center member.

The operator triggers the release means to actuate the propulsion means to launch a ball toward a target.

BRIEF DESCRIPTION OF THE DRAWINGS

The invention will be further described as to an illustrative embodiment in conjunction with the accompanying drawings in which:

FIG. 6 is a perspective view of the frame coupling means.

PREFERRED EMBODIMENT

Figure 1:
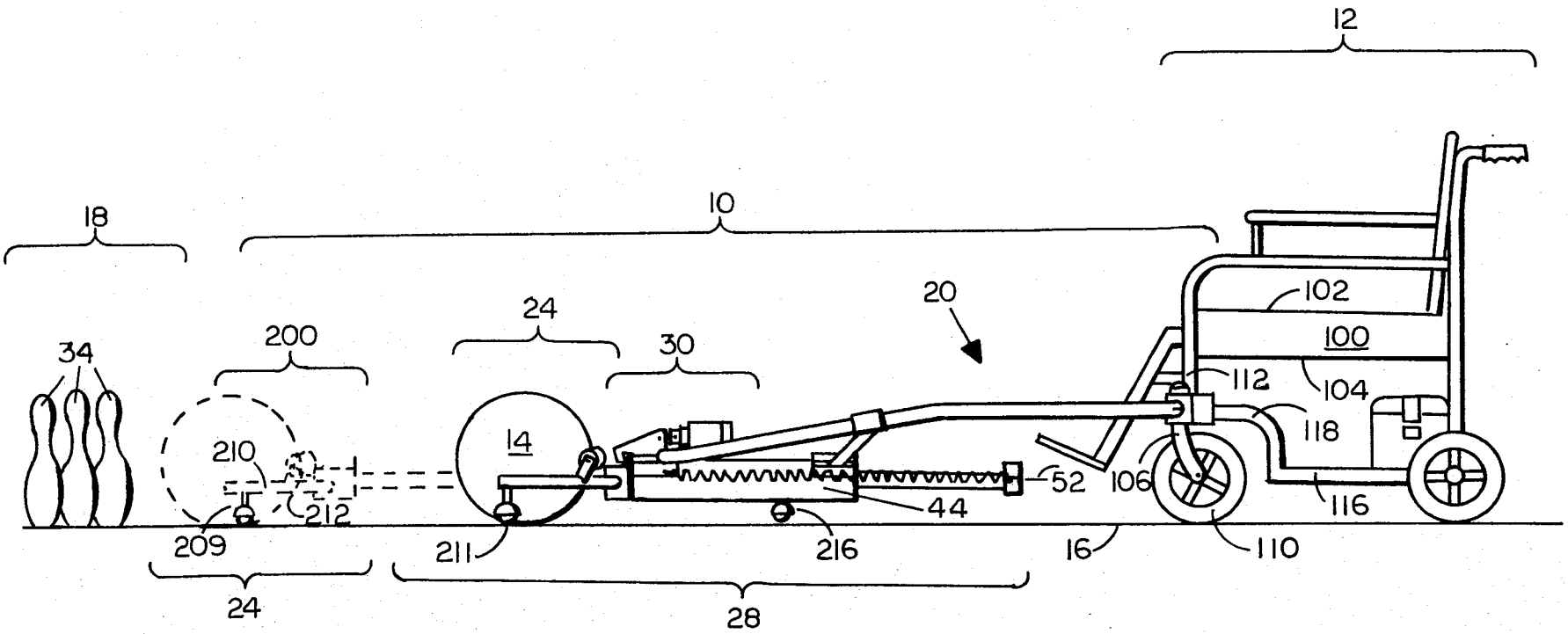
FIG. 1 is a side elevation showing the invention bowling apparatus coupled to a wheelchair.

Referring to FIG. 1, there is shown the invention apparatus 10 for use by an operator in a wheelchair 12 to triggerably launch a ball 14 to roll in a preselected direction on a navigable surface 16 toward a target 18. The invention bowling apparatus 10 is further adapted to control the terminal velocity of the ball 14 at its release.

Figure 2:
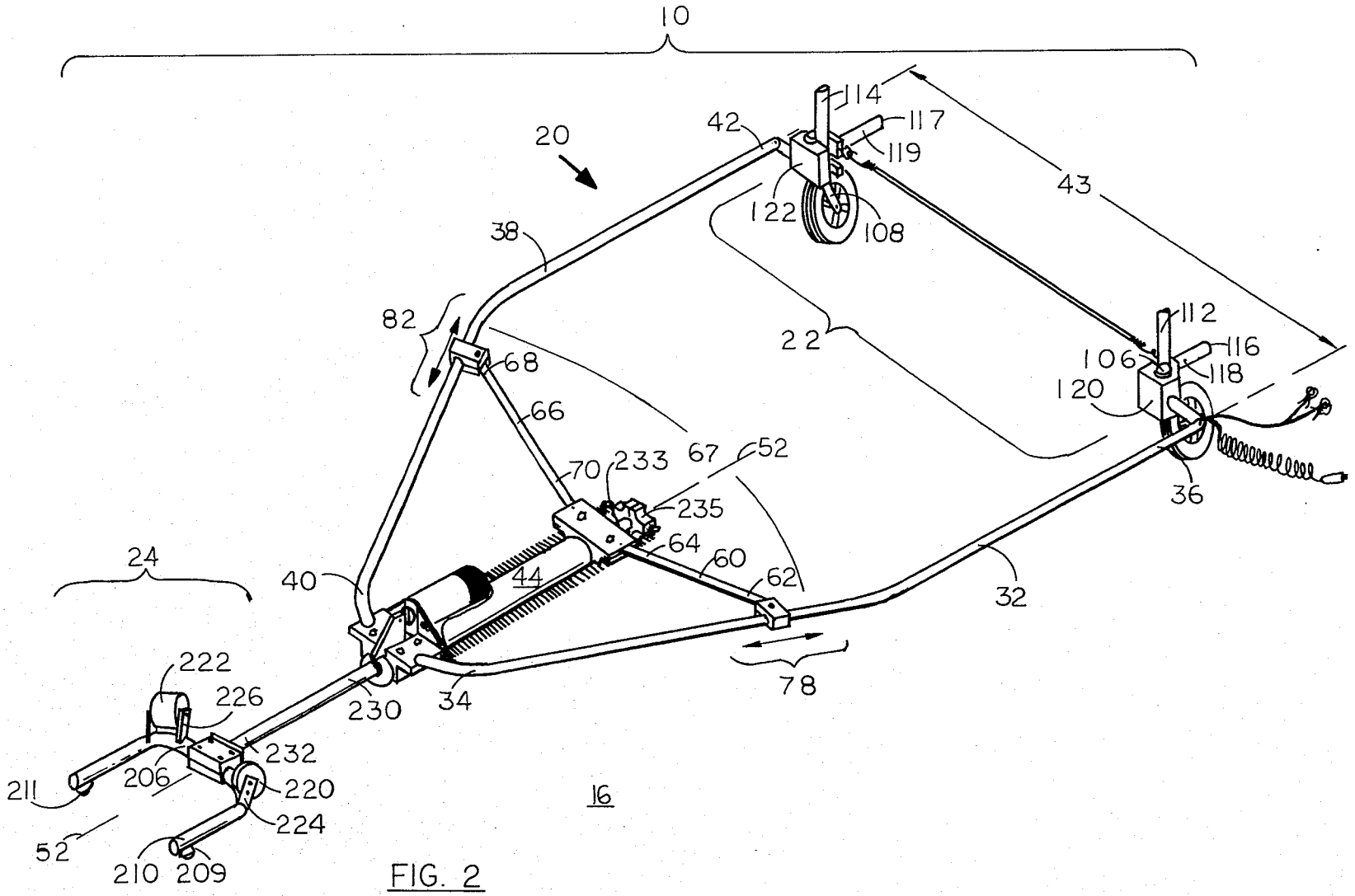
FIG. 2 is the invention bowling apparatus in perspective.

Referring now to FIG. 2, the invention bowling apparatus 10 is shown comprising a frame 20 disposed in relative horizontal relation or in relative parallel plane relation with the navigable surface 16 along with a coupling means 22 for coupling the frame 20 to the wheelchair's vertical supports and lateral braces 112, 114; 116, 117 (partially shown). A ball receiving means 24 is shown for holding the ball 14 (shown in phantom) in registration.

Referring again to FIG. 1, propulsion means 28 has a reset configuration, as shown in solid lines, and in a released configuration as shown in phantom lines. The propulsion means 28 is further adapted to release energy upon being released to the released configuration. The propulsion means 28 also couples the ball receiving means 24 to the frame 20 in wheelchair driven, frame coupled, target pointing relation for imparting a predetermined directional thrust to the ball receiving means 24.

Release means 30, for latching the propulsion means 28 into a reset configuration, is depicted rigidly coupled to center member 44. The release means 30 is responsive to operator triggering to actuate, i.e., to release, the propulsion means to the released configuration; thereby, allowing the propulsion means 28 to impart the predetermined directional thrust to the ball receiving means 24.

Subsequent to latching the propulsion means 28 into a reset configuration, the operator, or operator's assistant, positions the wheelchair 12 to align the propulsion means 28 with the operator selected target 18, such as pins 34. The operator (not shown) thereafter places a ball 14 in the receiving means 24. After placing the wheelchair 12 in motion toward the target 18, or from a stationary chair position, the operator, at operator election, triggers the release means 30 to actuate or remotely release the propulsion means 28; thereby thrusting the ball 14 toward the target 18 in the preselected direction.

Figure 4A:
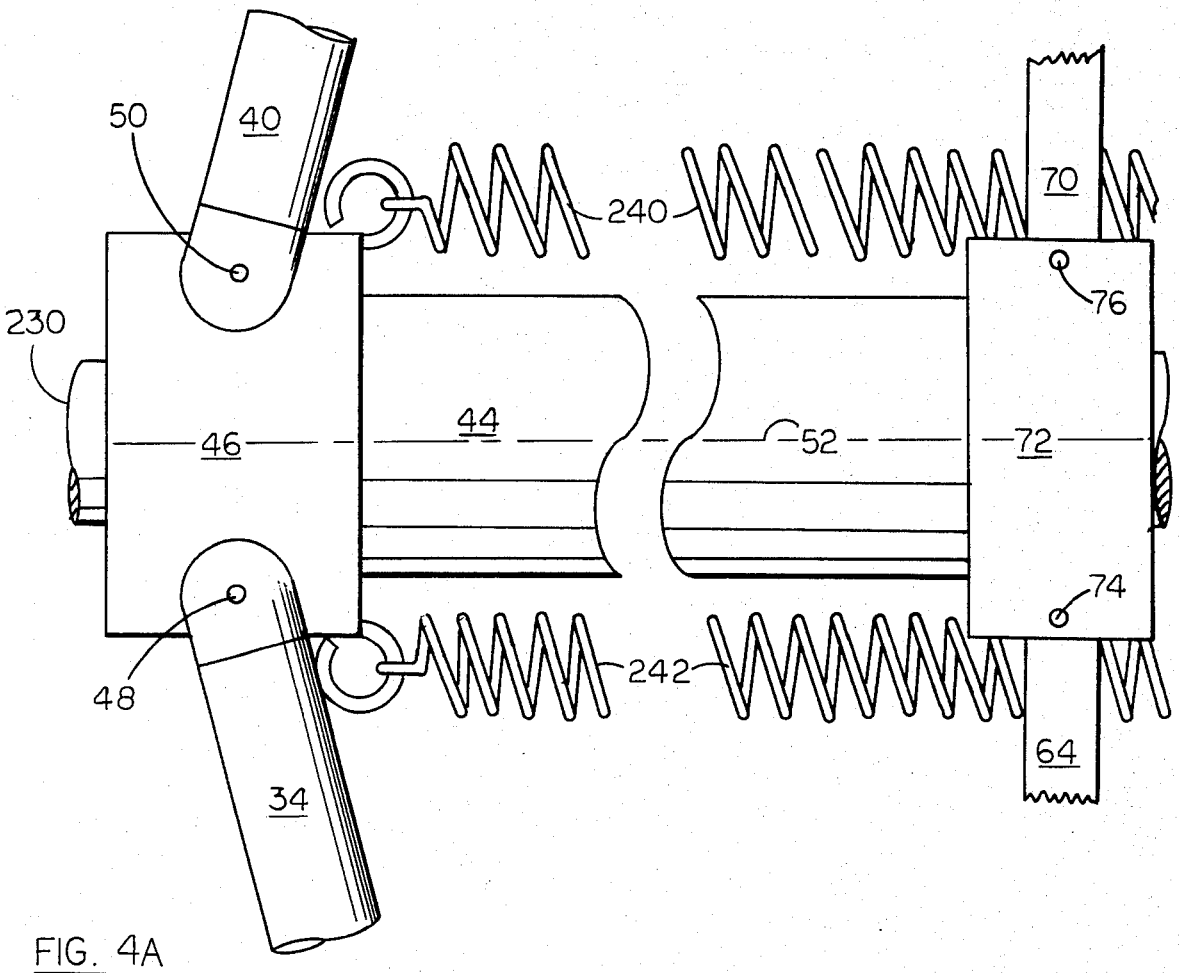
FIG. 4*a* is an expanded plan elevation view of the center member.
Figure 4:
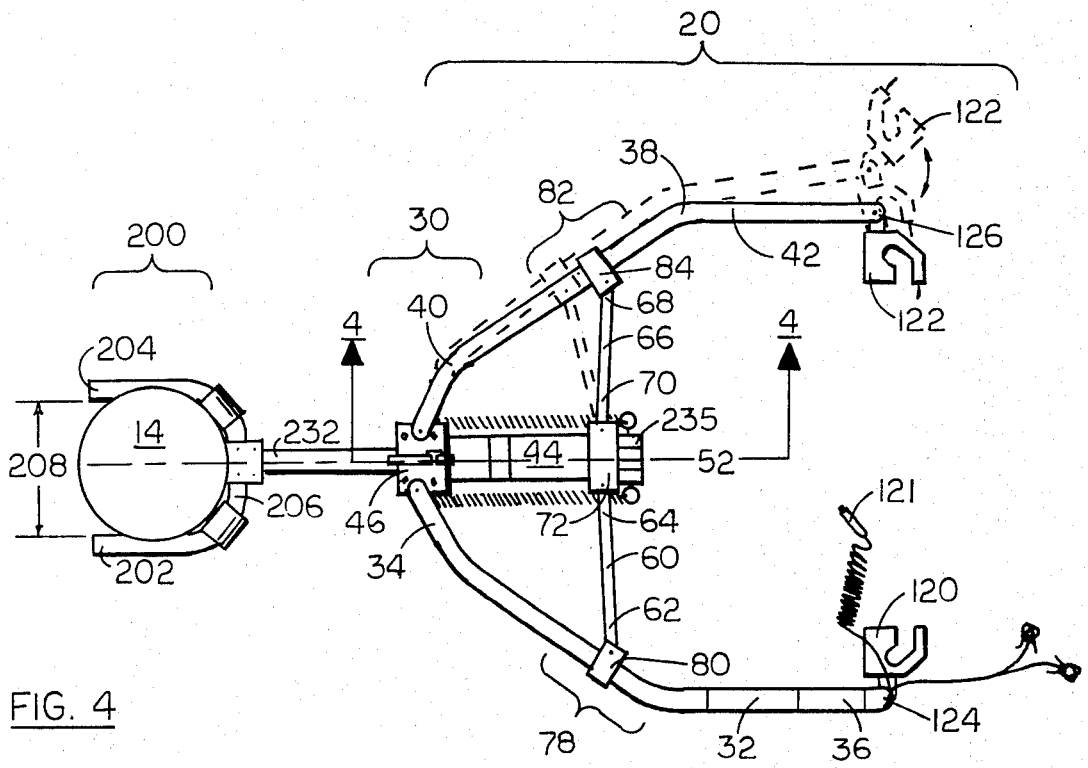
FIG. 4 is a plan elevation view of the invention bowling apparatus.

Referring now to FIG. 4, the frame 20 further comprises: a left member 32 having a first and second end 34, 36; a right member 38 having a first and second end 40, 42; a left spreader 60 having a first and second end 62, 64; a right spreader 66 having a first and second end 68, 70. Referring to FIG. 4*a*, center member 44 is shown in an expanded elevation plan view of a portion of FIG. 4 as having a first end 46 having a left and right pivot point 48, 50 and a second end 72 having a left and right pivot point 74, 76. The center member 44 has a longitudinal axis, co-axial with center line 52. As shown in FIG. 1, the center line 52 is disposed in relatively planar relation with the navigable surface 16. FIG. 4 shows center member 44 centrally positioned between the left and right frame members 32, 38.

Means for slidably and pivotally coupling the left spreader first end 62 to the left member mid-region 78 includes, for example, adjustable clamp 80. Means for slidably and pivotally coupling the right spreader first end 68 to the right member mid-region 82 includes, for example, adjustable clamp 84.

Referring now to FIG. 4*a*, means for pivotally coupling the left member first end 34 to the center member first end left pivot point 48 includes, for example, a shaft passing through axially aligned and corresponding holes in the center member first end left pivot point 48 and the left member first end 34. Means for pivotally coupling the left spreader second end 64 to the center member second end left pivot point 74 includes, for example, a shaft passing through axially aligned and corresponding holes in the left spreader second end 64 and the center member second end left pivot point 74. Means for pivotally coupling the right member first end 40 to the center member first end right pivot point 50 includes, for example, a shaft passing through axially aligned and corresponding holes in the right member first end 40 and the center member first end right pivot point 50. Means for pivotally coupling the right spreader second end 70 to the center member second right pivot point 76 includes, for example, a shaft passing through axially aligned and corresponding holes in the right spreader second end 70 and the center member second end right pivot point 76.

Referring now to FIG. 2, the respective coupling means are further adapted and adjusted to position and hold the left member 32, right member 38, center member 44, left spreader 60 and right spreader 66 in dihedral or intersecting plane relation, where left member 32 and left spreader 60 form a first plane and where right member 38 and right spreader 66 form a second plane, the first and second planes intersecting at center member 44, and having angle of intersection 67.

The respective means for slidably and pivotally coupling the left and right spreader first ends 62, 68 respectively to the left and right member midregions 78, 82 are slidably adjusted to conform the distance 43 between the left and right member second ends 36, 42 to the width of the wheelchair 12 (not shown) in frame and wheelchair coupling relation and are also adjusted to align the frame center member longitudinal axis 52 with the direction of forward travel of the wheelchair 12. The frame center member longitudinal axis 52 forms a target pointing axis.

Referring again to FIG. 1, the wheelchair 12 is further adapted to have a seating platform 100 having an upper and lower surface, 102, 104. Referring again to FIG. 2, left and right caster 106, 108 are depicted, each caster having a rotable wheel such as 110, in contact with the navigable surface 16. The seating platform 100 is disposed in relatively horizontal seating relation with the navigable surface 16 above the casters 106, 108.

The seating platform 100 is supported by a left and right forward vertical supports, such as 112 and 114. The left forward vertical support 112 (partially shown) is vertically interposed between the left forward caster 106 and the seating platform lower surface 104. The right forward vertical support 114 is vertically interposed between the right forward caster 108 and the seating platform lower surface 104 (not shown). As shown in FIGS. 5*a* through 5*c* and FIG. 6, lower left longitudinal brace 116 has a forward end 118 rigidly coupled to the left forward vertical support 112 in close relation to the caster 106.

Referring to FIG. 2, lower right longitudinal brace 117 has a forward end 119 rigidly coupled to the right forward vertical support 114 in close relation with the right caster 108. The coupling means for coupling the frame 20 to the wheelchair 12 (not shown) further comprises: a left and right integral body piece 120, 122.

The left and right integral body pieces 120, 122 are further adapted to be swiveled from an uncoupled position to a coupled position to respectively engage and couple to respective left and right forward vertical supports 112, 114. After swivelling and engaging the left and right body integral pieces 120, 122 with the respective left and right vertical supports 112, 114, the coupling means for coupling the frame 20 to the wheelchair couples the frame to the wheelchair in relative horizontal relation with the navigable surface 16.

Figure 5A:
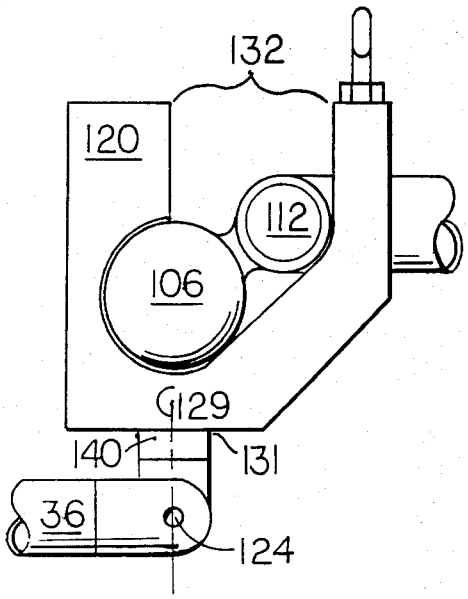
FIGS. 5*a* through 5*c* are elevation views of the invention bowling apparatus frame coupling means.
Figure 5C:
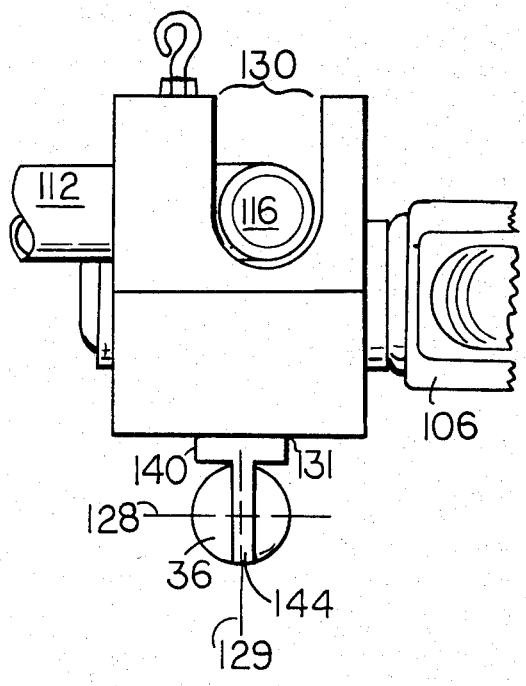
Figure 5B:
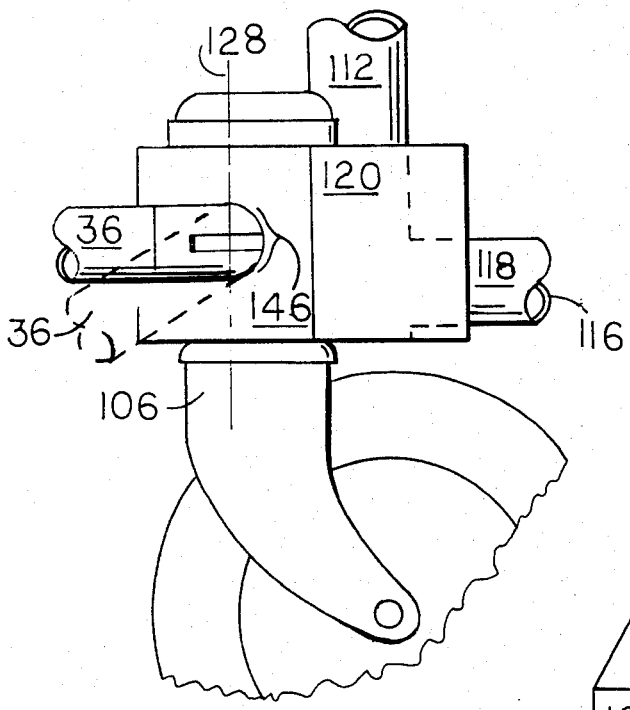
Figure 5D:
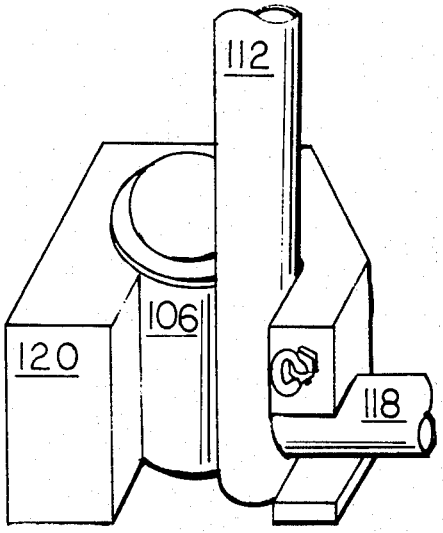

Referring now to FIGS. 5*a* through 5*c*, a preferred means for coupling as a swivel is shown by depicting the left integral body piece 120 coupled to left frame member second end 36 and vertical support 112. This alternative means for coupling as swivel includes left and right blade elements, 140, 142. Right blade element 142, is not shown in FIGS. 5*a* through 5*c* but is shown in FIG. 2. Referring to FIG. 5*c* each respective blade element has a blade end, such as 144 and a pivot end, such as 140.

Each respective left and right frame member second end has a yoke, such as slot 146 depicted in FIGS. 5*b* and 5*c*. The yokes, such as slot 146, are adapted to receive a respective blade element blade end, such as 144 in relatively horizontal plane relation, i.e., in a plane that is relatively horizontal, such as shown in FIG. 5*b*. The embodiment of FIG. 5*a* shows a means for pinning each respective blade end in its respective yoke, i.e. with pin 124 shown penitrating vertically into swivel axis 128. Each respective blade element, such as 140, and yoke, such as 146 are adapted to permit free pivotal movement of said blade ends in said yokes on a swivel axis, such as 128. The swivel axis is relatively normal or orthogonal to the navigable surface 16. Each respective blade element pivot end, such as 146 is pivotally coupled on a pivot axis, such as 129 to the respective integral body piece, such as 120.

Referring to FIG. 5*c*, each respective integral body piece is further adapted to have a respective pivotal surface, such as 131 and where the pivotal axis, such as 129 is normal to the pivotal surface 131. Each respective integral body piece is adapted when coupled to a respective vertical support, such as 112 and in the case of FIG. 5*b*, to caster 106, to position its respective pivotal axis, such as 129, to be relatively horizontal. The pivotal axis is transverse to said center member longitudinal axis when the integral body pieces are positioned to engage the vertical supports.

The means for coupling each respective blade element pivot end, such as 140, to end to a respective integral body piece pivotal surface, such as 131, provides pivotal freedom for the frame to permit said frame to travel across surfaces slightly non-planar or inclined to said navigable surface. Means for coupling as a swivel, the right integral body piece 122 (not shown) to the frame right member second end 42 is similarly accomplished.

Referring to FIG. 2, the right integral body piece 122 is adapted to engage and couple to the right forward vertical support 114 at a point above the right forward caster 108. Upon swiveling and engaging the left and right integral body pieces 120, 122 with the respective left and right vertical supports 112, 114, the coupling means for coupling the frame 20 to the wheelchair 12 couples the frame 20 to the wheelchair 12 with the centerline 52 of the center member 44 being in horizontal relation with the navigable surface and being the line of intersection of a first plane formed by the left member 32, the left spreader 60, and the centerline 52 and a second plane formed by the right member 38, the right spreader 66 and the centerline 52.

Referring to FIG. 5*c*, the means for coupling the left integral body piece 120 to the left member second end 36 further comprises means for pivoting the left integral body piece 120 on a left vertical axis, such as 128 through the left member second end 36, and wherein the means for coupling the right integral body piece 122 to the right member second end 42 further comprises: means for pivoting the right integral body piece 122 on a right vertical axis (not shown) through the right member second end, the left and right vertical axes being relatively normal to the navigable surface 16.

Referring now to FIG. 5*c*, an end elevation from FIG. 5*a*, the left integral body piece 120 and right integral body piece (not shown) is further adapted to engage and rigidly couple to the respective lower left longitudinal brace 116 and lower right longitudinal brace (not shown). An alternative embodiment is depicted in which a slot 130 is formed in integral body piece 120 to receive the lower right longitudinal brace 116 while a vertical slot 132, depicted in FIG. 5*a*, concurrently receives left vertical support 112 and caster body 106. The left and right integral body pieces 120, 122, when swiveled into a coupled position, concurrently engage respective left and right forward vertical supports such as 112 and respective lower left and lower right longitudinal braces, such as 116, to rigidly couple the respective left and right frame members 32, 38 to the chair in intersecting plane relation with the navigable surface 16.

Referring again to FIG. 4, the right integral body piece 122 is depicted in dark lines in a first wheelchair engaging position and in phantom lines in a released position. The left integral body piece 120 is simillarly adapted to be swiveled, as described above at pivot point 124, from an uncoupled position to a coupled position, to engage and couple to the left forward vertical support 112 at a point above the left forward caster 106.

FIG. 4 also shows an alternative and prefered embodiment of a ball receiving means comprising a U-shaped frame 200 having integrally shaped left and right parallel sides 202, 204 and a base member 206, the parallel sides 202, 204 being spaced to restrain and register the ball 14 prior to launching. The spacing 208 is adapted to provide a ball release aperture.

Referring to FIG. 1, the U-shaped frame 200 has an upper and lower surface 210, 212, the lower surface 212 being disposed in relatively horizontal relation with the navigable surface 16. The U-shaped frame member 200 is coupled to the propulsion means 28 for imparting a predetermined directional thrust to the ball receiving means. The ball receiving means is adapted to hold the ball 14 in registration as the ball 14 is accelerated towards the target 18. The ball exits the ball release aperture 208 at termination of the acceleration. The ball thereafter follows the operator controlled wheelchair driven and aligned preselected course toward the target 18.

FIG. 1 shows the ball receiving means including means for supporting the U-shaped frame 200 to prevent the U-shaped frame 200 from being deflected into the navigable surface 16. The means for supporting the U-shaped frame 200, is meant to include, for example, ball caster 209.

Referring to FIG. 2, the means for supporting the U-shaped frame is meant to include means such as left and right U-shaped frame casters 209 and 211 respectively. Each respective caster 209, 211 has a roller, the left and right casters being respectively coupled to the U-shaped frame left and right lower surface 212 and each respective roller being in contact with the navigable surface 16. The left and right U-shaped frame casters 209, 211 operate to fix the distance between the U-shaped frame 200 and the navigable surface 16.

Referring now to FIG. 2, the spin control means is adapted to be responsive to operator control to preselect the amount of torque applied to the ball 14 as the ball receiving means 200 is accelerated by the propulsion means 28 prior to launch of the ball 14. The spin control means is shown comprised of: first and second thrust rollers 220,222, each respective thrust roller being rotatably mounted in respective left and right thrust roller yokes, 224, 226. The left and right thrust roller yokes are positioned on the U-shaped frame upper surface 210 at opposing ends of the base member 206. The yokes 224, 226 are further adapted to position the left and right rollers 220, 222 to contact the ball at alternate points of contact above the navigable surface 16 at a height exceeding a distance equivalent to the radius of the ball 14. At launch, thrust force is applied at points of roller contact and operate in cooperation with the frame to accelerate the ball in response to release of the propulsion means. Contacting the ball at alternate points at a height above the navigable surface 16 exceeding the radius of the ball 14 insures that the rollers will transmit vertical downward force to the ball 14 as well as lateral force for purposes of accelerating the ball. The operator can control and preadjust the drag on one or both of the left and right thrust rollers 220, 222 by adjusting the tension on the respective yokes 224, 226. A slight drag on the rollers produces a torque on ball 14 as ball 14 is accelerated. The torque produced on ball 14 by the operator selected dragon thrust rollers 220, 222 results in the ball's assuming a predetermined spin at the conclusion of the ball acceleration.

Figure 3:
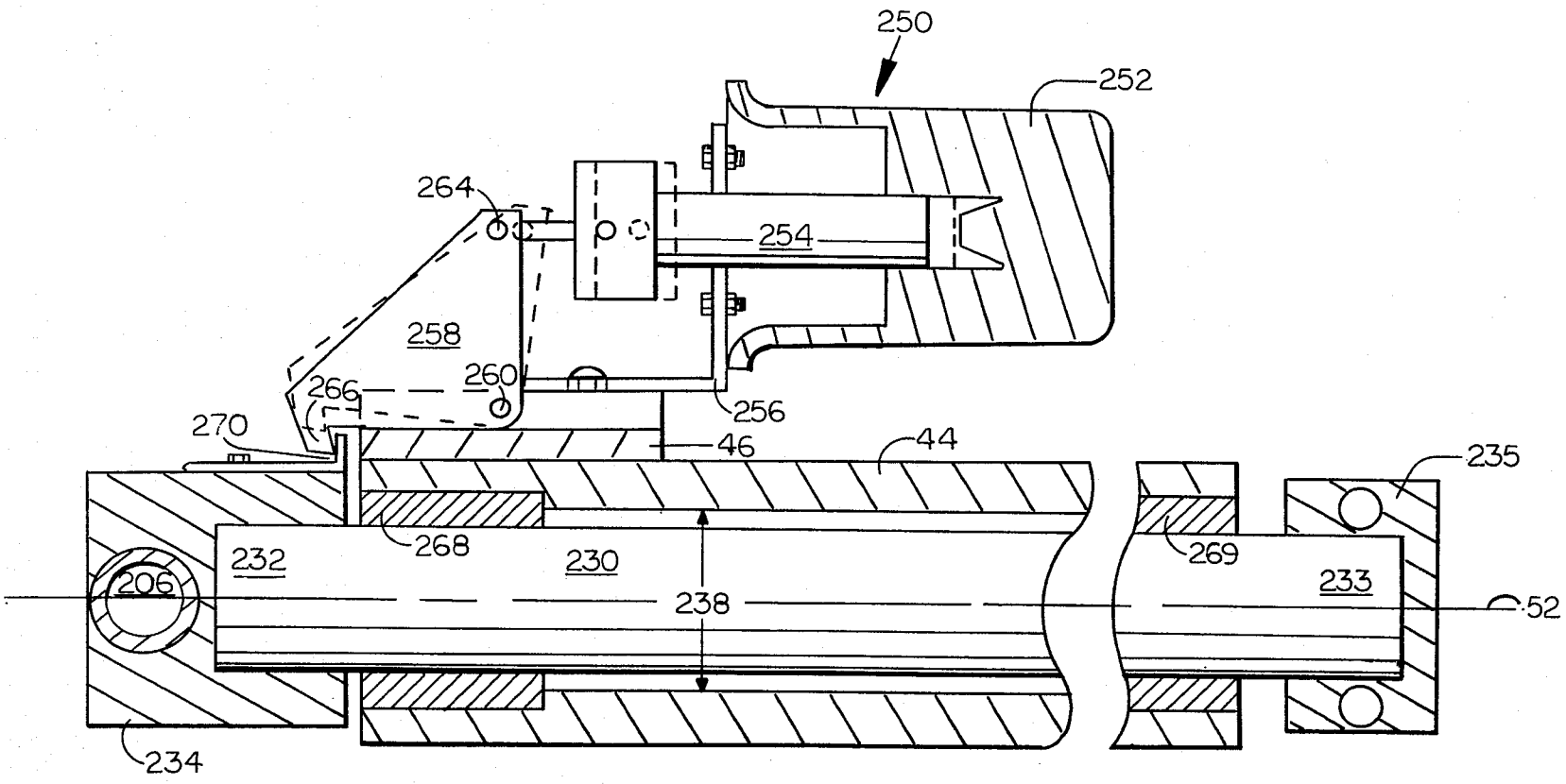
FIG. 3 is a sectional view of the invention bowling apparatus release means taken along line 4—4 of FIG. 4.

Referring to FIG. 1, the propulsion means 28 further comprises as shown in FIG. 3, a drive piston 230 having a first and second end 232, 233, the drive piston first end 232 being rigidly coupled to the ball receiving means base member 206. A guide means for receiving and guiding the drive piston 230 is contained within center member first end 46 and center member second end 72.

Referring to FIG. 3, The above refferenced guide means is depicted comprising forward linear bearing 268 and aft linear bearing 269, each of these respective bearings being pressed into center member 44. in parallel relation with the frame center member longitudinal axis 52 through a predetermined thrust translation, the drive piston 230 being positioned and held by the guide means in parallel relation with the frame center member 44 longitudinal axis 52. The guide means is meant to include, for example, a cylinder formed in the center member 44 of sufficient diameter 230 to receive the drive piston 230 having a forward end 232 and an aft end 233. The aft end 233 is depicted having collar 235 attached. Collar 235 is adapted in the preferred embodiment to include spring coupling means, such as rings for receiving spring ends (not shown).

FIG. 3 is a sectional drawing that depicts the drive piston 230 being in coaxial alignment with the center member's longitudinal axis 52. The drive piston is positioned and held by the guide means in parallel relation with the frame center member longitudinal axis 52.

Referring to FIG. 4*a*, the propulsion means 28 includes a resettable energy storage means for storing energy. The restorable energy storage means is meant to include, for example, springs 240 and 242. The resettable energy storage means is responsive to triggering of the release means by the operator to provide a thrust force at the drive piston second end 233 with respect to the frame center member 44. The direction of the force delivered to the piston is relatively parallel to the center member longitudinal axis 52 and directed from the center member second end 72 towards the center member first end 46; whereby, the drive piston 230, being responsive to the force and being positioned and held by the guide means such as in the center member bore hole 238, propells the ball receiving means 200 through a predetermined thrust translation to launch the ball 14 to the target 18.

The ball receiving means 200 comprises a U-shaped frame having integrally shaped left and right parallel sides 202, 204 and a base member 206, the parallel sides being spaced to restrain and register the ball 14 prior to launching. The spacing is adapted to provide a ball release aperture 208. The U-shaped frame has an upper and lower surface 210, 212, the lower surface 212 being disposed in relatively horizontal relation with the navigable surface 16. The drive piston first end 232 is rigidly coupled to the U-shaped frame base member 206.

Means for supporting the U-shaped frame in horizontal relation with and at a predetermined height above the navigable surface 16 is envisioned to include ball casters such as ball caster 211 depicted in FIGS. 1 and 2. Each respective U-shaped frame caster has a roller, and each respective caster roller is in contact with the navigable surface 16. The U-shaped frame casters operate to support the U-shaped frame at a predetermined height above the navigable surface 16.

Referring now to FIG. 3, a release means for latching the propulsion means 28 into a reset configuration is depicted. The release means is responsive to operator triggering to release the propulsion means to to the released configuration.

The release means for latching the propulsion means into a reset is also shown in FIG. 3 and includes solenoid 250 having a solenoid housing 252 and a plunger 254, the solenoid being rigidly coupled to the center member 44 by bracket 256. A bell crank 258 is included, the bell crank 258 having a pivot point 260, a solenoid plunger coupling point 264 and a latch 266. The propulsion means drive piston first end 232 is provided with a cavity formed by the right angle 270 in the right angle bracket adapted to receive the latch 266.

FIG. 3 shows an alternative embodiment in which a collar 268 shown in section is coupled to the drive piston first end 232. Bell crank latch 266 drops into cavity 270 as drive piston 230 is moved to its extreme rightmost position in the course of resetting the propulsion means. To release the propulsion means, the operator closes a switch, such as switch 121 depicted in FIG. 4, to an electrical source to operate the solenoid to triggerably release the propulsion means.

Referring again to FIG. 3, at switch closure, solenoid plunger 254 moves to the right applying force to bell crank solenoid plunger coupling point 264 causing bell crank 258 to pivot on bell crank pivot point 260 lifting bell crank latch 266 from cavity 270 thereby releasing drive piston 230 to move to the left in response to spring 240, 242 release of energy.

In operation, the operator drives the chair with invention bowling apparatus attached against a fixed obstruction causing a compressive force to be applied to the ball receiving means thereby driving the drive piston 230 into its guide and extending springs 240, 242 until bell crank latch 266 is received by cavity 270. The operator or an assistant subsequently places ball 14 into ball receiving means 24 after which the operator electrically drives the chair to position the apparatus for launch. The spin control means is pre-adjusted by the operator to achieve a predetermined spin on ball 14 at launch.

Other braking methods for first and second thrust rollers are envisioned and include electromagnetic frictional braking electrically preselected by the operator. Magnetic clutches can be adapted for this purpose as well as electric motors responsive to a control voltage.

The invention bowling apparatus spin control means envisions an alternative embodiment incorporating electrically controlled, motor driven, first and second thrust rollers. Electrical controls would be provided for each motor whereby an operator could remotely apply electrical power to each respective motor during acceleration, for the purpose of accelerating or braking the torque applied to the ball 14 during acceleration.

There is thus provided a bowling apparatus particularly useful to paraplegic or other wheelchair operators interested in pursuring recreational bowling activities. The description provided is intended to be illustrative only and is not intended to be limitive. Those skilled in the art may conceive of modifications which fall within the purview of the description; however, such modifications are intended to be included therein as well. The scope of this invention shall be determined from the scope of the following claims including their equivalents.

What is claimed is:

1. A wheelchair bowling apparatus for use by an operator in a wheelchair to triggerably launch a ball, said ball rolling in a preselected direction on a navigable surface toward a target, said bowling apparatus being further adapted to control the terminal velocity of said ball at release, said wheelchair bowling apparatus comprising:

a frame disposed in relative horizontal relation with said navigable surface;

said frame having;

a left member having a first and second end, a right member having a first and second end, a left spreader having a first and second end, a right spreader having a first and second end, a center member having a first end having a left and right pivot point, and a second end having a left and right pivot point, said center member having a longitudinal axis disposed in relatively horizontal relation with said navigable surface and centrally positioned between said left and right frame members, means for coupling said left spreader first end to said left member mid-region, means for coupling said right spreader first end to said right member mid-region, means for coupling said left member first end to said center member first end left pivot point, means for coupling said left spreader second end to said center member second end left pivot point, means for pivotally coupling said right member first end to said center member first end right pivot point, means for coupling said right spreader second end to said center member second end right pivot point, each respective coupling means being further adapted and adjusted to position and hold said left member, right member, center member, left spreader and right spreader in fixed relation, said respective means for coupling said left and right spreader first ends to said left and right member mid-regions being adjusted to conform the distance between said left and right member second ends to the width of said wheelchair in frame to wheelchair coupling relation and to align said frame center member longitudinal axis with the direction of forward travel of said wheelchair, said frame center member longitudinal axis forming a target pointing axis, a coupling means for coupling said frame to said wheelchair;

ball receiving means for holding said ball in registration;

propulsion means for imparting a preselected thrust to said ball receiving means, said propulsion means being further adapted to couple said ball receiving means to said frame in wheelchair driven, frame coupled, target pointing relation for imparting a predetermined directional thrust to said ball receiving means;

release means for actuating said propulsion means, said release means being responsive to operator triggering thereby, allowing said propulsion means to impart said predetermined directional thrust to said ball receiving means;

whereby, said operator positions said wheelchair to align said propulsion means with said operator selected target, said operator, or operators assistant, thereafter placing a ball in said receiving means, and after placing said wheelchair in motion toward said target, or from a stationary wheelchair position, said operator, at operator election, triggers said release means to actuate said propulsion means;

thereby, thrusting said ball, toward said target, in said preselected direction.

2. In the combination of claim 1, said wheelchair being further adapted to have a seating platform having an upper and lower surface and a left and right caster, each said caster having a rotatable wheel in contact with said navigable surface, said seating platform being disposed in relatively horizontal seating relation with said navigable surface above said casters, said seating platform being supported by:

a left forward vertical support, said left forward vertical support being vertically interposed between said left caster and said seating platform lower surface, a right forward vertical support, said right forward vertical support being vertically interposed between said right caster and said seating platform lower surface, a lower left longitudinal brace having a forward end rigidly coupled to said left forward vertical support in close relation with said left caster, a lower right longitudinal brace having a forward and rigidly coupled to said right forward vertical support in close relation with said caster, said coupling means for coupling said frame to said wheelchair further comprising:

a left and right integral body piece, means for coupling as a swivel said left and right integral body pieces respectively to respective left and right member second ends, said left and right integral body piece being further adapted to be swiveled from an uncoupled position to a coupled position to respectively engage and couple to respective left and right forward vertical supports;

whereby, upon swiveling and engaging said left and right body integral pieces with said respective left and right vertical supports, said coupling means for coupling said frame to said wheelchair couples said frame to said wheelchair in relative horizontal relation with said navigable surface.

3. The combination of claim 2 wherein; said means for coupling as a swivel said left and right integral body pieces to respective left and right member second ends further comprises:

left and right blade elements, each respective blade element having a blade end and a pivot end, and wherein each respective left and right frame member second end has a yoke, each respective yoke being adapted to receive a respective blade element blade end in relatively horizontal plane relation, means for pinning on a swivel axis each respective blade end in its respective yoke, each respective blade element and yoke being adapted to permit free pivotal movement of said blade ends in said yokes on said swivel axis, said swivel axis being relatively normal to said navigable surface, each respective blade element pivot end being pivotally coupled on a pivot axis to a respective integral body piece.

4. The combination of claim 3, wherein each respective integral body piece is further adapted to have a respective pivotal surface and where said pivotal axis is normal to said pivotal surface, each respective integral body piece being adapted when coupled to a respective vertical support to position its respective pivotal axis to be relatively horizontal and transverse to said center member longitudinal axis;

whereby, said means for coupling each said respective blade element pivot end to a respective integral body piece pivotal surface provides pivotal freedom for said frame to permit said frame to travel across surfaces slightly non-planar or inclined to said navigable surface.

5. The combination of claim 4, wherein said left and right integral body pieces are further adapted to engage and rigidly couple to said respective lower left and lower right longitudinal braces;

whereby, said left and right integral body pieces, when swiveled into a coupled position, concurrently engage respective left and right forward vertical supports and respective lower left and lower right longitudinal braces to rigidly couple said respective left and right frame members to said chair in intersecting plane relation with said navigable surface.

6. The combination of claim 1, wherein said ball receiving means further comprises:

a U-shaped frame having integrally shaped left and right parallel sides and a base member, said parallel sides being spaced to restrain and register said ball prior to launching, said spacing being adapted to provide a ball release aperture, said U-shaped frame having an upper and lower surface, said lower surface being disposed in relatively horizontal relation with said navigable surface, said U-shaped frame member being coupled to said propulsion means for imparting a predetermined directional thrust to said ball receiving means;

whereby, said ball receiving means is adapted to hold said ball in registration as said ball is accelerated toward said target, said ball exiting said ball release aperature at termination of said acceleration, said ball thereafter following said operator controlled, wheelchair driven and aligned, preselected course toward said target.

7. The combination of claim 6, wherein said center member further comprises:

means for supporting said center member in relative horizontal relation with, and at a predetermined height above, said navigable surface;

whereby, said means for supporting said center member operates to prevent said center member from being deflected toward said navigable surface.

8. The combination of claim 7, wherein said means for supporting said center member further comprises:

a caster, said caster being coupled to said caster member and being adapted to prevent said center member from being deflected into said navigable surface.

9. The combination of claim 6, wherein said ball receiving means further includes:

means for supporting said U-shaped frame in horizontal relation with and at a predetermined height above said navigable surface;

whereby, said means for supporting said U-shaped frame operates to prevent said U-shaped frame from being deflected into said navigable surface.

10. The combination of claim 7 wherein said means for supporting said U-shaped frame further comprises a left and right casters, each respective caster having a roller, said left and right casters being respectively coupled to said U-shaped frame left and right side lower surface, said respective rollers being in contact with said navigable surface;

whereby, said left and right U-shaped frame casters operate to fix the distance between said U-shaped frame and said navigable surface.

11. The combination of claim 1, further comprising: spin control means, said spin control means being responsive to operator control to pre-select the amount of torque applied to said ball as said ball receiving means is accelerated by said propulsion means prior to launch of said ball;

whereby, said operator controls said ball spin as said ball travels to said target.

12. The combination of claim 11, wherein said spin control means is further comprised of:

first and second thrust rollers, each respective thrust roller being rotatably mounted in respective left and right thrust roller yokes, said left and right thrust roller yokes being positioned on said U-shaped frame upper surface at opposing ends of said base member, said yokes being further adapted to position said left and right rollers to contact said ball at alternate points of contact above the navigable surface at a height exceeding a distance equivalent to the radius of the ball;

whereby, at launch, thrust force applied at points of roller contact and operate in cooperation with said frame to accelerate said ball in response to release of said propulsion means, in continuous contact with said navigable surface.

13. The combination of claim 12 wherein said spin control means is further comprised of first and second thrust rooller break means for applying, at operator election, a predetermined breaking torque to said first and second thrust rollers, said first and second thrust rollers being selected to apply a frictional load in cooperation with thrust applied at each respective point of rollers contact with said ball;

whereby, thrust force at said respective points of contact in cooperation with said ball contact with said navigable surface cooperate to induce a predetermined spin as said ball is accelerated.

14. The combination of claim 1; wherein, said propulsion means further comprises:

a drive piston having a first and second end, said drive piston first end being rigidly coupled to said ball receiving means base member, a guide means coupled to said frame center member for receiving and guiding said drive piston in parallel relation with said frame center member longitudinal axis through a predetermined thrust translation, said drive piston being positioned and held by said guide means in parallel relation with said frame center member longitudinal axis, a resettable energy storage means for storing energy, said resettable energy storage means being responsive to triggering of said release means by said operator to provide a thrust force at said drive piston second end with respect to said frame center member, the direction of said force being relatively parallel to said center member longitudinal axis and directed from said center member second end toward said center member first end;

whereby, said drive piston, being responsive to said force and being positioned and held by said guide means, translates said ball receiving means through said predetermined thrust translation to launch said ball to said target.

15. The combination of claim 14, wherein said resettable energy storage means further comprises:

at least one spring having a first and second end, said first end being coupled to said drive piston second end, and said second end being coupled to said center member;

whereby, each said spring is extended beyond its relaxed length as said propulsion means is latched in a reset configuration, said spring operating to store energy in its extended configuration and releasing said energy in response to release means unlatching said propulsion means in response to operator triggering.

16. The combination of claim 5, wherein said left and right integral body pieces are further adapted to be coupled together by at least one frame spring means, said frame spring means being adapted to couple said left and right integral body pieces in rigid contact with said left and right vertical supports respectively.

17. The combination of claim 16 wherein said frame spring means further comprises at least one elastomeric bungee; said elastomeric bunggee coupeling said left and right integral body pieces to said left and right vertical supports;

whereby, said integral body pieces are conveniently and quickly coupled and decoupled from said left and right vertical supports.

18. The combination of claim 12, wherein said release means for latching said propulsion means into a reset configuration further comprises:

a solenoid having a housing and a spring restored and electrically actuated plunger, said solenoid housing being rigidly coupled to said center member, a bell crank, said bell crank having a pivot point, a solenoid plunger coupling point and a latch, said drive piston first end having a cavity adapted to receive said bell crank latch, said bell crank plunger coupling point being coupled to said solenoid plunger, said bell crank pivot point being coupled to said center member, said bell crank being free to pivot on said pivot point;

whereby, upon being electrically actuated, said solenoid plunger is moved in relation to said solenoid housing, said solenoid plunger being coupled to said bell crank coupling point applies a torque to said bell crank about said bell crank pivot point, said bell crank rotating in response to said torque drawing said latch from said drive piston cavity thereby releasing said drive piston, said drive piston being driven by said extended propulsion means spring to transmit force to said ball receiving means base member in response to operator triggering of said electrical solenoid.

19. The combination of claim 11 wherein, said spin control means is further comprised of first and second thrust roller motor means for applying, at operator election, independent torques to said first and second thrust rollers, said torque being further adapted to either break or accelerate said ball spin as said ball is accelerated subsequent to operator release;

whereby, said first and second thrust rollers operate to provide predetermined torques to said ball during acceleration to achieve a predetermined spin on said ball.

* * * * *